US009387596B2

(12) United States Patent
Krause

(10) Patent No.: US 9,387,596 B2
(45) Date of Patent: Jul. 12, 2016

(54) INSULATION CUTTING TOOL

(71) Applicant: Advanced Architectural Products, LLC, Allegan, MI (US)

(72) Inventor: G Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 64 days.

(21) Appl. No.: 14/504,352

(22) Filed: Oct. 1, 2014

(65) Prior Publication Data

US 2015/0089817 A1 Apr. 2, 2015

Related U.S. Application Data

(60) Provisional application No. 61/885,468, filed on Oct. 1, 2013.

(51) Int. Cl.
*B26B 3/08* (2006.01)
*B26B 25/00* (2006.01)

(52) U.S. Cl.
CPC ..... *B26B 3/08* (2013.01); *B26B 25/005* (2013.01)

(58) Field of Classification Search
CPC ..... B26B 3/08; B26B 25/005
USPC ..... 39/131, 132, 173, 194, 205, 263, 280
See application file for complete search history.

(56) References Cited

U.S. PATENT DOCUMENTS 480,878 A * 8/1892 Rounds ..... B26B 25/00 30/263
702,788 A * 6/1902 Geczynski ..... B26F 1/382 139/47
734,304 A * 7/1903 Crecelius ..... B23D 29/023 30/240
752,264 A * 2/1904 Simmons ..... B26B 25/00 30/263
860,503 A * 7/1907 Boyer ..... B26B 25/00 30/263
1,488,832 A * 4/1924 Rauth ..... B26B 25/005 30/263
1,566,797 A * 12/1925 Holtzman ..... B26B 19/36 30/132
1,594,963 A * 8/1926 James ..... B26B 27/005 30/2
1,757,531 A * 5/1930 Kinkela ..... B26B 25/005 30/263
1,988,379 A * 1/1935 Gilles ..... B26B 25/005 30/123
2,174,222 A * 9/1939 Florian ..... B26B 25/005 30/178
2,230,042 A * 1/1941 Mertens, Jr. ..... B29D 30/68 30/140
2,238,222 A * 4/1941 Jones ..... B26B 5/005 30/280

(Continued)

*Primary Examiner* — Sean Michalski
(74) *Attorney, Agent, or Firm* — The Watson I.P. Group, PLC; Jovan N. Jovanovic; Vladan M. Vasiljevic

(57) ABSTRACT

An insulation cutting tool configured to cut fiber based insulation that is coupled to an underlying vapor barrier such as a vinyl web, transverse to the vinyl web without adversely damaging the vinyl web. The tool includes a body, an upper guide, a lower guide and a cutting assembly. A guide can also be coupled to the body to provide an outside guide to assist with the cut. Finally, a wall utilizing insulation cut by the insulation cutting tool is disclosed.

8 Claims, 4 Drawing Sheets

(56) References Cited

U.S. PATENT DOCUMENTS 2,369,221 A * 2/1945 Dunsheath ..... B26F 3/002 174/122 R
2,436,560 A * 2/1948 Feather ..... B26B 13/28 330/266
2,464,206 A * 3/1949 Becker ..... B26B 3/04 30/304
2,707,849 A * 5/1955 De Vore ..... C03B 33/10 125/37
3,921,287 A * 11/1975 Gomez ..... A47J 17/00 30/123.5
4,062,110 A * 12/1977 Alvarez ..... H02G 1/1297 30/370
4,173,313 A * 11/1979 Rogers ..... B21C 47/006 242/525.4
4,283,853 A * 8/1981 Fazzini ..... B23D 19/04 30/265
4,360,970 A * 11/1982 Ostroski ..... B26B 25/005 30/2
4,646,438 A * 3/1987 Hessler ..... B23D 29/005 30/115
4,693,004 A * 9/1987 Plana ..... B26B 25/005 30/265
4,739,554 A * 4/1988 Hytonen ..... B23D 21/08 30/101
4,901,400 A * 2/1990 Karubian ..... B27B 19/008 30/173
5,127,162 A * 7/1992 Mansfield ..... A22B 5/168 30/280
5,251,378 A * 10/1993 Ayer ..... B26B 25/005 30/132
5,428,898 A * 7/1995 Hawkins ..... B26B 25/005 30/295
5,469,622 A * 11/1995 Gradoni ..... B26B 13/22 30/114
5,561,905 A * 10/1996 Sherman ..... B26B 27/00 30/280
5,881,463 A * 3/1999 Casteel ..... B26B 29/00 30/280
6,154,967 A * 12/2000 Rogala ..... B26B 25/005 30/164
6,298,561 B1 * 10/2001 Decker ..... B26B 29/06 30/265
6,584,694 B2 * 7/2003 Chen ..... B26B 25/005 30/307
6,591,503 B1 * 7/2003 Voves ..... A47G 21/02 30/142
6,684,745 B2 * 2/2004 Shen ..... B23D 25/12 83/105
7,290,339 B1 * 11/2007 Schmelzer ..... B26B 27/005 30/2
7,624,507 B2 * 12/2009 Bergstrand ..... B26B 25/005 30/280
8,046,922 B2 * 11/2011 Eby ..... B26B 29/02 30/151
8,220,162 B2 * 7/2012 Rayner ..... B26D 1/205 30/240
8,782,909 B1 * 7/2014 Davis ..... B26B 5/003 30/2
8,875,406 B2 * 11/2014 Collard ..... B26B 5/00 30/280
2005/0193564 A1 * 9/2005 Trbovich, Jr. ..... B26B 3/00 30/115
2013/0014394 A1 * 1/2013 Yu Chen ..... B26B 29/00 30/276
2016/0008991 A1 * 1/2016 Peppett ..... B26B 5/005 30/280

* cited by examiner

INSULATION CUTTING TOOL

CROSS-REFERENCE TO RELATED APPLICATION

This application claims priority from U.S. Provisional Patent Application Ser. No. 61/885,468 entitled Insulation Cutting Tool, filed Oct. 1, 2013, the entire specification of which is hereby incorporated by reference.

BACKGROUND OF THE DISCLOSURE

1. Field of the Disclosure

The invention relates in general to construction tools, and more particularly, to an insulation cutting tool that is configured for cutting insulation that is coupled to a substrate, without adversely affecting the substrate.

2. Background Art

The use of insulation on pre-engineered wall systems is known in the art. For example, and with reference to FIG. 1, a horizontal, or vertical metal stud is positioned. Insulation having an integrated vapor barrier is positioned over the stud, and a metal panel is positioned over the insulation. Subsequently, a fastener is driven through the metal panel and the insulation, and into the stud. As a result, the insulation is greatly compressed around the stud due to the fastener. The compression greatly reduces the insulative effect of the insulation.

Problematically, the reduced insulation greatly reduces the effectiveness of the overall wall system. In many instances, such a construction will be in violation of local building codes. However, if the insulation is cut around the studs, the integrated vapor barrier is cut, thereby destroying the barrier properties thereof.

Thus, it would be desirable to provide a means by which to overcome the compressive deficiencies of the arrangement of FIG. 1, while maintaining the integrity of the vapor barrier.

SUMMARY OF THE DISCLOSURE

In order to overcome the deficiencies of the prior art, an exemplary system is shown in FIG. 2. In this Figure, the same configuration is shown, with certain enhancements. First, a girt (preferably a polymer based girt) is coupled to the underlying stud which is of a thickness that substantially matches the insulation. The girt may be of the type disclosed in U.S. Publication No. 2013/0152498 published to Krause, entitled Polymer-Based Bracket System For Exterior Cladding, as well as the type disclosed in any related applications. The entirety of each of these references, namely the publication, and any related applications is hereby incorporated by reference in its entirety.

The metal panel is then attached to the polymer girt. The girt maintains the insulation in a relaxed, non-compressed condition. It is desirable to have the vapor barrier that is integrated with the insulation extend over the outside of the girt so as to be sandwiched by the metal panel and the girt during assembly. In such a configuration, the vapor barrier remains intact. Problematically, such a configuration requires that the insulation be cut, without cutting the underlying vapor barrier (commonly a vinyl material). Execution of such a task can be quite difficult and time consuming.

The tool of the present disclosure provides a manner in which to cut insulation at a desired location without adversely affecting the vapor barrier, and, thereby maintaining the integrity of the vapor barrier.

In one aspect of the disclosure, the insulation cutting tool includes a body, a cutting wheel aperture and a cutting assembly. The body includes a bottom end, a top end, a front edge and a back edge. The front edge defines an entrance region having an upper portion and a lower portion. The cutting wheel aperture is positioned at the entrance region between the upper portion and the lower portion. The cutting assembly includes a cutting wheel rotatably positionable within the cutting wheel aperture. A lower cutting edge extends from the lower portion of the front edge proximate the cutting wheel. Introduction of insulation into the entrance region imparts cooperation between the cutting wheel and the lower cutting edge to cut the insulation inserted therein.

In some configurations, the insulation cutting tool includes an upper guide positioned on the upper portion of the entrance region.

In some configurations, the insulation cutting tool includes a lower guide positioned on the lower portion of the entrance region.

In some configurations, the lower guide includes a lower face extending along the bottom end and meeting with an upper face extending along the lower portion of the front edge along the lower portion of the entrance region.

In some configurations, the insulation cutting tool includes a handle opening positioned between the cutting assembly and the top end, and between the front edge and the back edge.

In some configurations, the insulation cutting tool further includes a guide attachable to the body. The guide includes a first side on a first side of the body and a second side on a second side of the body, and at least one spanning member maintaining the operable position of the first and second sides relative to the body. At least a portion of the first side and the second side extending beyond the bottom end of the body away from the cutting wheel.

In some configurations, the at least one spanning member comprises a pair of spanning members.

In some configurations, the upper portion and the lower portion of the entrance region of the front edge are angled toward each other so as to be progressively closer to each other nearing the cutting wheel.

BRIEF DESCRIPTION OF THE DRAWINGS

The disclosure will now be described with reference to the drawings wherein.

DETAILED DESCRIPTION OF THE DISCLOSURE

Figure 1:
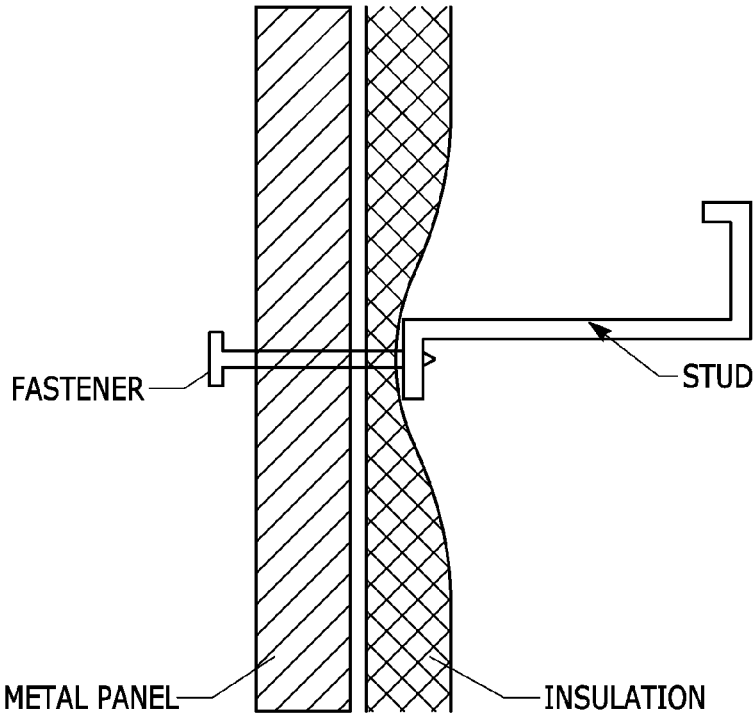
FIG. 1 of the drawings is a prior art configuration of a pre-engineered wall construction.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Figure 3:
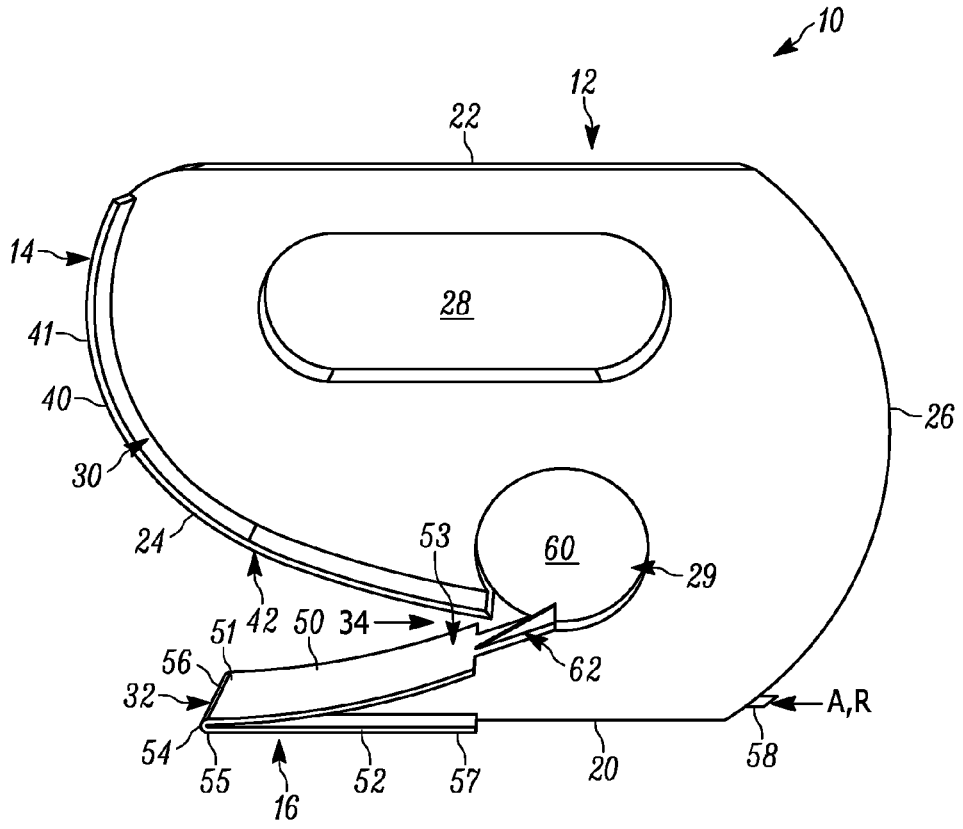
FIG. 3 of the drawings is a perspective view of the tool of the present disclosure.
Figure 4:
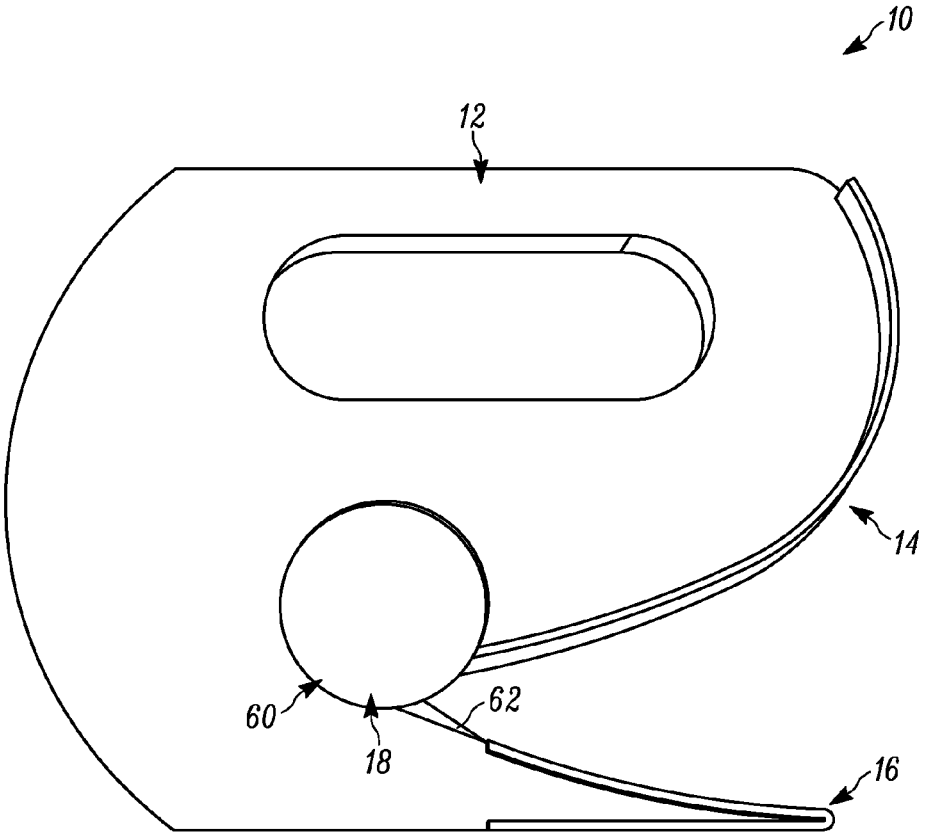
FIG. 4 of the drawings is a side elevational view of the tool of the present disclosure.
Figure 5:
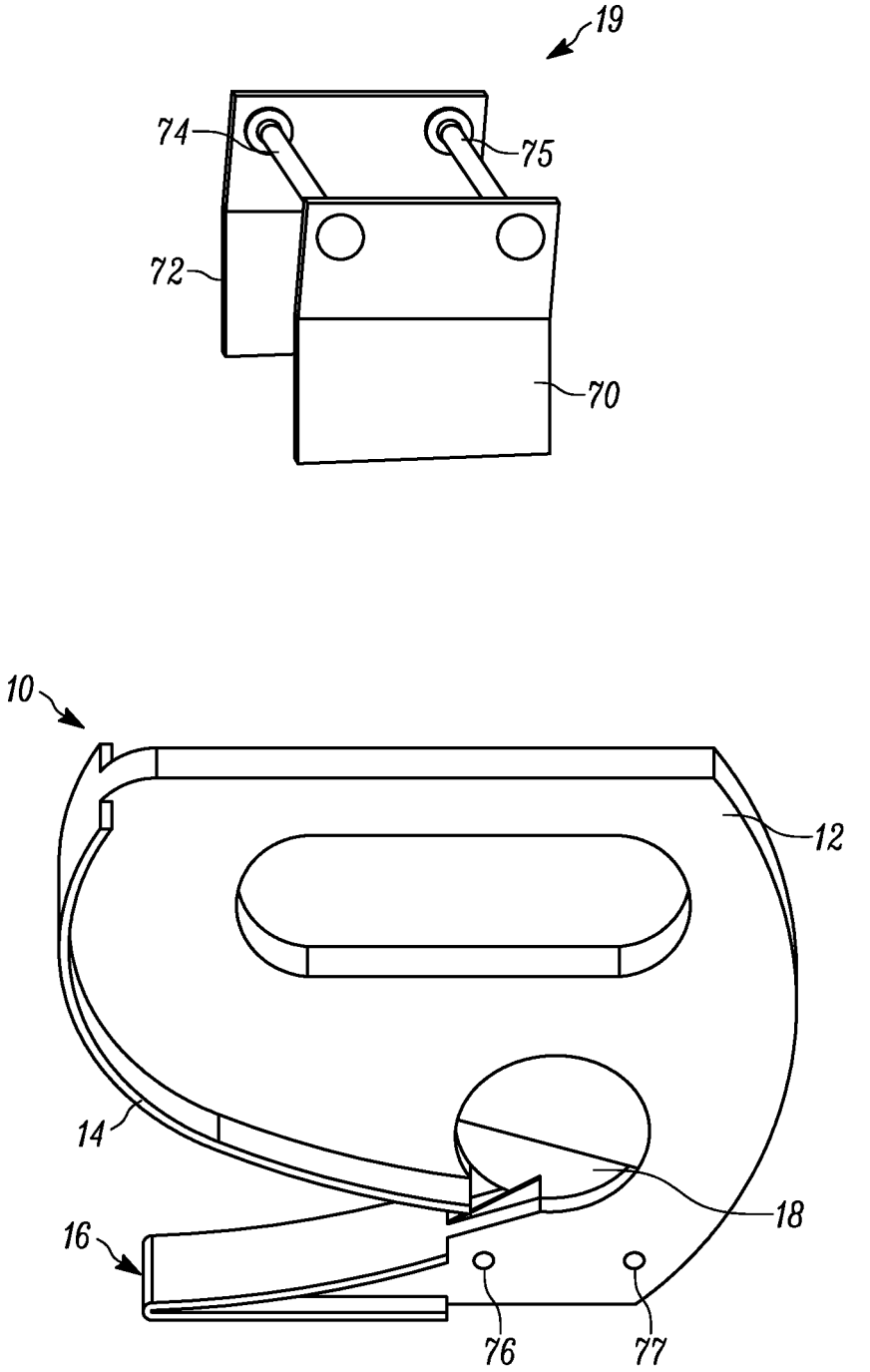
FIG. 5 of the drawings is a perspective view of a tool of the present disclosure having a guide of the present disclosure for coupling thereto.

Referring now to the drawings and in particular to FIGS. 3 through 5, the insulation cutting tool is shown generally at 10. The insulation cutting tool is generally configured to cut fiber based insulation that is coupled to an underlying vapor barrier such as a vinyl web, transverse to the vinyl web without adversely damaging the vinyl web. It will be understood that the insulation is typically fiberglass or similar compressible material that can be compacted and directed to the cutting wheels. Of course, the tool is not limited to any particular insulation material.

The insulation cutting tool 10 includes body 12, upper guide 14, lower guide 16, cutting assembly 18, and, optionally, guide 19. The body 12 comprises a generally substantially planar member. In the embodiment disclosed, the body is generally a substantially planar member of a substantially uniform thickness. The body 12 includes a bottom end 20, top end 22, front edge 24 and back edge 26. A handle opening 28 extends just below the top end so that the user can wrap around the top end and extend the fingers through the handle opening. In other embodiments, a handle opening may be positioned proximate the back edge 26 so that the user can extend the palm over the back edge and extend the fingers through such an opening. In certain embodiments, multiple handle openings are provided.

The front edge 24 is generally split on either side of an entrance region 34. The front edge includes an upper portion 30 above the entrance region 34 and a lower portion 32 below the entrance region. The two portions 30, 32 are configured to direct insulation toward and into the entrance region.

The cutting wheel aperture 29 is positioned at the entrance region and is configured to retain the cutting wheel 60 in an orientation that is substantially perpendicular to the upper and lower guides 14, 16 and substantially parallel to the body 12. The particular size and configuration of the cutting wheel aperture is in part defined by the size and shape of the cutting wheel.

The upper guide 14 extends along the upper portion 30 and follows the curve thereof toward and into the entrance region 34. The guide itself comprises a generally planar member that is substantially perpendicular to the body 12 at the front edge 24. In many embodiments, the guide is approximately three times the width of the body and generally evenly spaced on the front edge, so as to appear as a generally centered flange. Of course, other configurations are likewise contemplated. The upper guide includes a front face 40 which is the insulation contact face, and includes upper section 41 and lower section 42 which cooperate to funnel the insulation toward the entrance region 34.

The lower guide 16 is shown as comprising upper face 50, lower face 52 and vertex 54. The upper face extends along the lower portion 32 of the front edge 24, and is directed to the entrance region 34. The lower face 52 extends along the bottom end 20. The upper face and the lower face meet at vertex 54. The configuration of the upper and lower faces is similar to the upper guide, in that the faces have the configuration of centered guides that extend along the aforementioned surfaces. The upper face 50 has outer end 51 and inner end 53. The lower face has outer end 55 and inner end 57. The outer ends 51 and 55 meet at vertex 54.

The configuration of the upper and lower faces 50, 52 is such that the insulation is urged to separate from the underlying vinyl. That is, the lower face 52 contacts the vinyl inner surface, while the upper face spreads away (and pulls away) the insulation. In certain embodiments, an air passage may extend to the vertex 54 so that a source of compressed air can be directed through an opening at the vertex 54 so as to aid in the separation of the underlying vinyl from the insulation. The compressed air can be controlled in any number of different formats, such as continuous, pulsed, etc. In other embodiments, the vertex 54 may be sharpened to facilitate the spreading effect. It will be understood that the upper and lower faces can be adjusted in angle so as to achieve the desired separation force.

The cutting assembly 18 includes cutting wheel 60 and lower cutting edge 62. The pair of cutting devices work together to slice through the insulation. The cutting wheel 60 comprises a wheel having a sharp edge extending around the perimeter thereof. The wheel is configured to rotate within the cutting wheel aperture 29 in a generally unbound manner.

The lower cutting edge 62 extends upwardly from the upper face 50 of the lower guide 16. The lower cutting edge comprises an inclined edge that extends further from the upper face the closer the edge is to the entrance region 34. The lower cutting edge interfaces with the cutting wheel 60 and is offset to one side thereof. Together the two cutting edges separate insulation in a generally straight cut.

In certain embodiments, an additional guide 19 may be provided. The guide includes first side 70 and second side 72. Spanning spacer members 74, 75 extend and join the first side 70 to the second side 72. The first side 70 and the second side 72 are positioned on opposite sides of the body 12 with the spanning spacer members extending through openings 76, 77 that extend near the bottom end behind the lower portion of the front edge. The guide can be used in a situation wherein the insulation can be wrapped around a stud or other element, with one guide extending on each side of the underlying stud, allowing for a centrally located cut by the cutting assembly.

In operation, in either the embodiment with a guide, or without a guide, the user first is provided with an insulation member that comprises a compressible fiberglass or other fiber type material that is mounted on a substrate (and in many instances, a vinyl substrate). The user positions the insulation in a desired configuration. Once positioned, the user can locate an edge of the insulation. At that edge, the vertex 54 of the lower guide is directed just above the vinyl at the interface between the vinyl and the insulation. At such time, the user continues the inward movement of the vertex 54 away from the edge.

Continued inward movement of the tool separates the insulation from the underlying vinyl at which time the vinyl generally abuts the lower face 52 of the lower guide 16. At the same time, the insulation is being compressed and directed by the upper guide 14 and the upper face 50 of the lower guide to compress and direct the insulation toward and into the entrance region. As the entrance region is reached, eventually, the insulation reaches the cutting assembly where the insulation is cut straight through. The cutting can continue until the other side of the insulation is reached, or otherwise. It will be understood that while the insulation has been cut, the insulation remains coupled to the vinyl and the integrity of the vinyl and insulation is maintained (other than for the portion that has been cut and the area immediately around the cut, which is also separated from the underlying vinyl as well).

Figure 2:
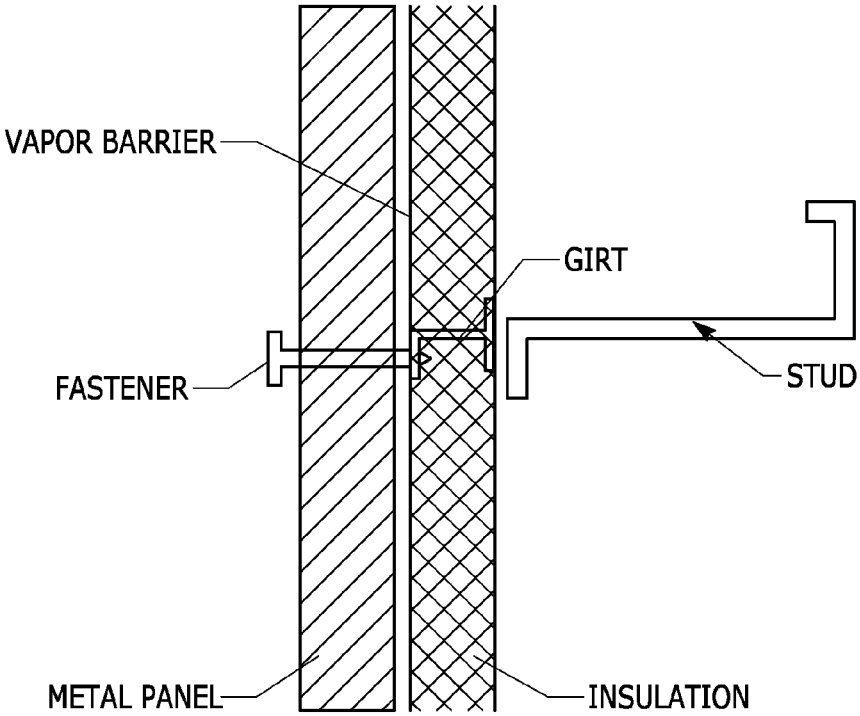
FIG. 2 of the drawings is a configuration of a pre-engineered wall construction of the present disclosure.

The cut insulation can then be installed, for example, in a manner that is shown in FIG. 2.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. An insulation cutting tool comprising:

a body having a bottom end, a top end, a front edge and a back edge, the front edge defining an entrance region having an upper portion and a lower portion;

a cutting wheel aperture positioned at the entrance region between the upper portion and the lower portion;

a cutting assembly including a cutting wheel rotatably positionable within the cutting wheel aperture, and a fixed inclined lower cutting edge extending from the lower portion of the front edge proximate the cutting wheel, wherein introduction of insulation into the entrance region imparts cooperation between the cutting wheel and the lower cutting edge to cut the insulation inserted therein.

2. The insulation cutting tool of claim 1 further comprising an upper guide positioned on the upper portion of the entrance region.

3. The insulation cutting tool of claim 2 further comprising a lower guide positioned on the lower portion of the entrance region.

4. The insulation cutting tool of claim 3 wherein the lower guide includes a lower face extending along the bottom end and meeting with an upper face extending along the lower portion of the front edge along the lower portion of the entrance region.

5. The insulation cutting tool of claim 1 further including a handle opening positioned between the cutting assembly and the top end, and between the front edge and the back edge.

6. The insulation cutting tool of claim 1 further comprising a guide attachable to the body, the guide including a first side on a first side of the body and a second side on a second side of the body, and at least one spanning member maintaining the operable position of the first and second sides relative to the body, at least a portion of the first side and the second side extending beyond the bottom end of the body away from the cutting wheel.

7. The insulation cutting tool of claim 6 wherein the at least one spanning member comprises a pair of spanning members.

8. The insulation cutting tool of claim 1 wherein the upper portion and the lower portion of the entrance region of the front edge are angled toward each other so as to be progressively closer to each other nearing the cutting wheel.

* * * * *